US005765690A

United States Patent [19]

Baxter

[11] Patent Number: 5,765,690

[45] Date of Patent: Jun. 16, 1998

[54] ARTICLE TRAY

[75] Inventor: Ronald A. Baxter, Douglasville, Ga.

[73] Assignee: The Mead Corporation, Dayton, Ohio

[21] Appl. No.: 895,081

[22] Filed: Jul. 16, 1997

[51] Int. Cl.[6] ..... B65D 5/44

[52] U.S. Cl. ..... 206/562; 206/1.5; 229/904; 229/198.2

[58] Field of Search ..... 206/557, 562, 206/563, 564, 784, 775, 1.5; 229/120, 904, 198.2

[56] References Cited

U.S. PATENT DOCUMENTS 2,833,458 5/1958 Toensmeier ..... 206/562

4,053,099 10/1977 Lock ..... 206/562

4,572,423 2/1986 Spencer ..... 229/904 X

*Primary Examiner*—Jacob K. Ackun

*Attorney, Agent, or Firm*—Michael V. Drew

[57] ABSTRACT

In an article tray a base panel (20) and an article-receiving panel (22) are spaced apart in parallel relation by side walls (24, 26). Lower end panels (40) foldably joined to each end of the base panel (20) have locking tabs (42), stabilizing tabs (44) and securement tabs (46) alternatingly disposed along the top edge of the lower end panels such that portions of the article-receiving panel are wedged between respective pairs of locking tabs (42) and securement tabs (46).

7 Claims, 3 Drawing Sheets

ARTICLE TRAY

TECHNICAL FIELD OF THE INVENTION

The invention relates to tray-style article carriers, and more particularly to a tray-style article carrier having parallel spaced-apart top and bottom walls and further having end walls joined and interlocked with the top and bottom walls and with one another.

BACKGROUND OF THE INVENTION

Tray-style article carriers are useful for storing and transporting articles. It is important that such a carrier be sturdy. The carrier must be sturdy even if it is formed from sheets of flexible material. It is often desirable to have such an article carrier that can be maintained in a collapsed condition when not in use. It is important that a collapsible article carrier be easily erected, sturdy and, once erected, able to maintain its erected state. When a carrier in general is formed from a blank of sheet material, it is important that the blank be formable as easily and economically as possible. Thus, it would be desirable to have a tray-style article carrier which is easily erected, sturdy, easily maintains an erected condition and formable from a blank which is easily and economically manufactured.

SUMMARY OF THE INVENTION

In accordance with a preferred embodiment of the invention, a base panel and an article-receiving panel are spaced apart in parallel relation to one another by side wall panels. End panels foldably joined to each end of the base panel have locking tabs formed along their top edges. Stabilizing tabs are also formed along the top edges of the end panels interspersed between the locking tabs. Securement tabs are foldably joined along the top edges of the end panels between the locking tabs and stabilizing tabs and are pivotable with respect to the end panel such that portions of the article-receiving panel are wedged between respective pairs of locking tabs and securement tabs.

DESCRIPTION OF THE PREFERRED EMBODIMENTS

Figure 1:
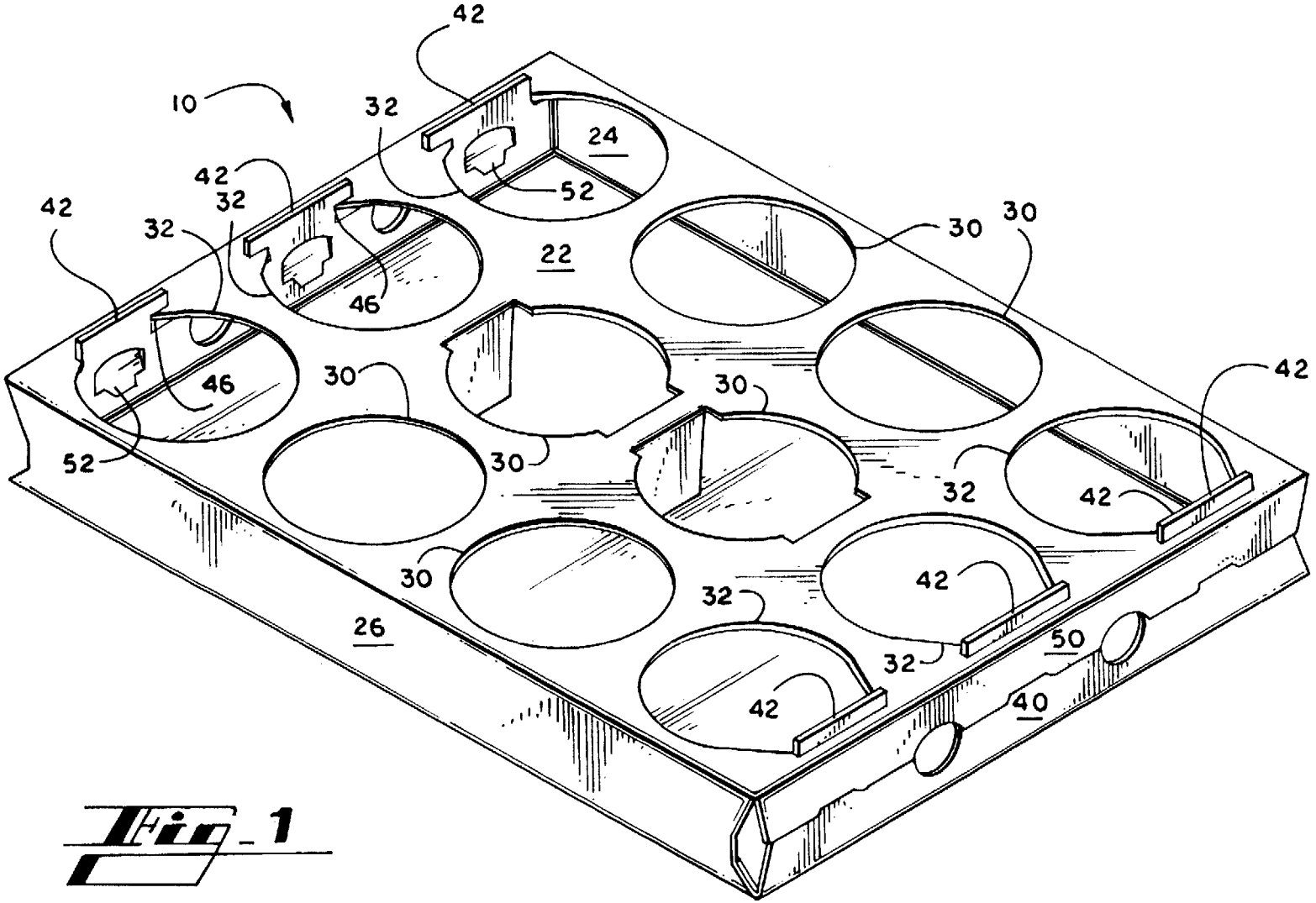
FIG. 1 is an isometric illustration of a tray-style article carrier according to a preferred embodiment of the invention.

Throughout the drawings the same reference numerals are used to refer to like features of the preferred embodiments illustrated.

Figure 3:
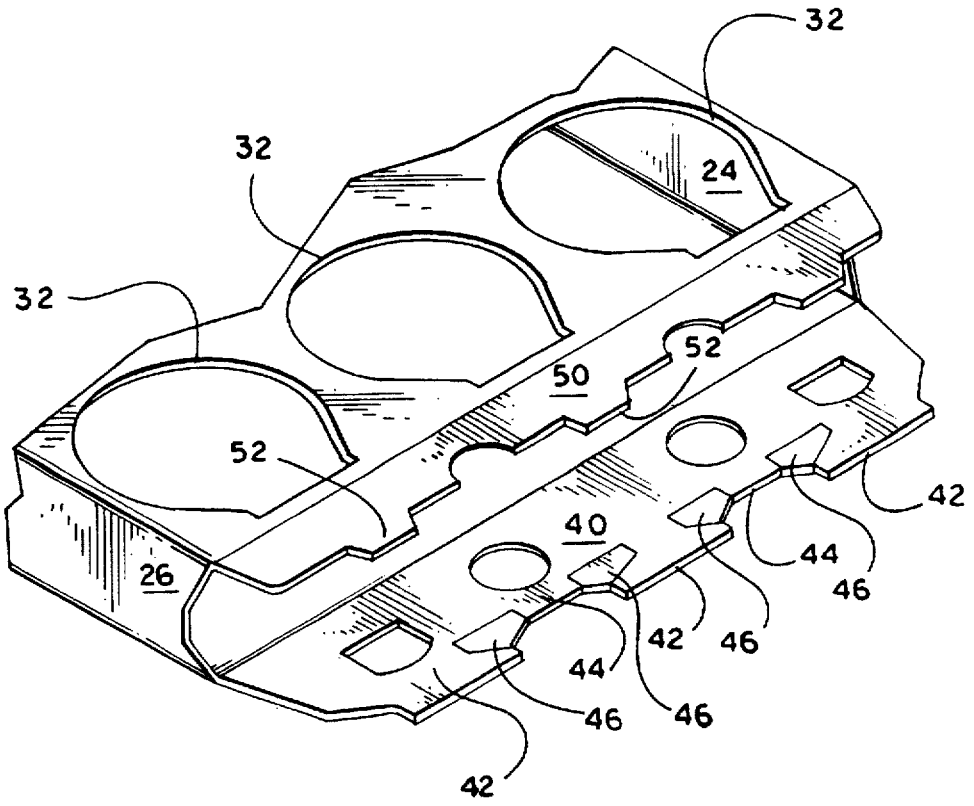
FIG. 3 is an isometric illustration of an end of the carrier of FIG. 1 prior to being closed.
Figure 4:
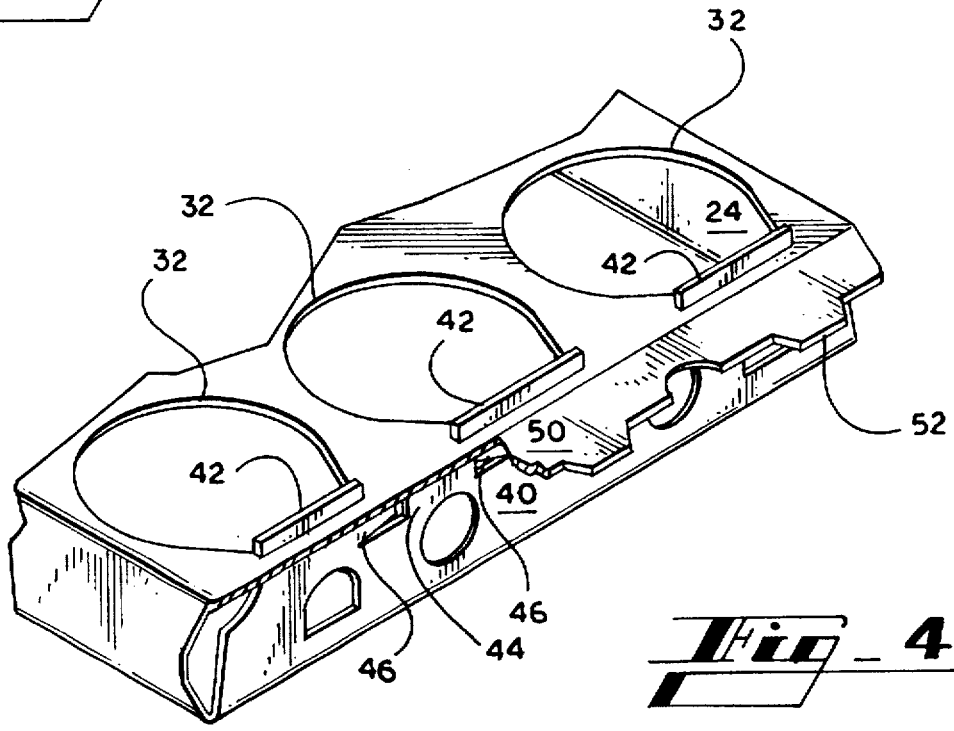
FIG. 4 is the same end view as FIG. 3 but partially closed.

Referring first to FIG. 1, therein is illustrated in isometric view a tray-style article carrier 10 according to a preferred embodiment of the invention. Reference may also be made generally to FIGS. 2–4 for a more complete understanding of the invention. A base panel 20 and article-receiving panel 22 are interconnected by side walls 24, 26. The base panel 20 may be considered a bottom wall or panel due to its disposition in the erected carrier 10. Similarly, the article-receiving panel 22 may be considered a top wall or panel. Article-receiving apertures 30 are disposed in the article-receiving panel 22. Disposed along the ends of the article-receiving panel are apertures 32 which serve both to receive articles and to interact with features described below for forming end closure for the carrier 10. Lower end panels 40 are pivotably adjoined to the end edges of the base panel 20. Locking tabs 42 having shoulders are formed along the top edges of the lower end panels 40. Stabilizing tabs 44 are interspersed between the locking tabs 42. Securement tabs 46 are pivotably joined to lower end panels 40 and interspersed between the locking tabs 42 and the stabilizing tabs 44 such that portions of the article-receiving panel 22 are wedged between respective pairs of shoulders of locking tabs 42 and securement tabs 46 while urging underside portions of the article-receiving panel 22 against the stabilizing tabs 44. Upper end panels 50 are joined to the ends of the article-receiving panel 22. Closure tabs 52 formed along the unattached edge of the upper end panels 50 interact with closure apertures 54 in the lower end panels 40 to lock the lower 40 and upper 50 end panels together.

The securement tabs 46 and locking tabs 42 interact to form a rigid structure that supports ends of the article-receiving panel 22. This reinforced structure is particularly useful when the carrier is formed from less dense or thinner substrate material or generally less substantial carrier material. Although the carrier provides optimum support when the locking tabs 42, stabilizing tabs 44 and securement tabs 46 are all used together, a degree of support is obtained by use of the locking tabs 42 and securement tabs 46 together without the stabilizing tabs 44.

Figure 2:
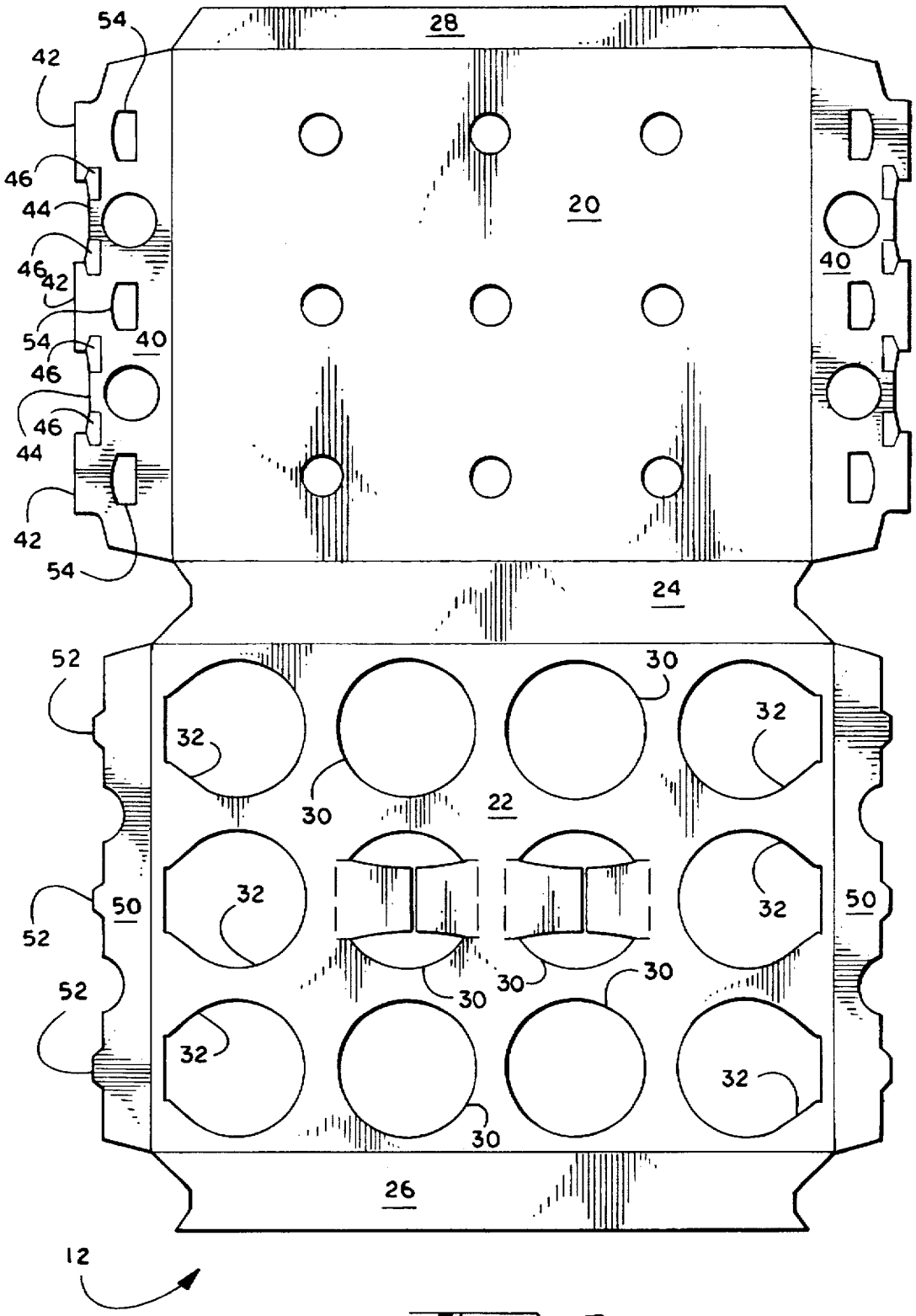
FIG. 2 is a plan view of a blank for forming the carrier of FIG. 1.

Referring now particularly to FIG. 2, the features of a blank 12 from which the carrier 10 may be formed will now be described. The base panel 20 and article-receiving panel 22 are foldably joined by a side wall panel 24. The second sidewall panel 26, which is joined to the base panel 20, is attachable to a glue flap 28 joined to the base panel 20. Lower end panels 40 are foldably joined to the base panel 20. The locking tabs 42, stabilizing tabs 44 and securement tabs 46 previously discussed are alternatingly aligned along the unjoined edges of the lower end panels 40. The upper end panels 50 are foldably joined to the article-receiving panel 22. Closure tabs 52 are formed along the edge of the upper end panels 50 for end-closure locking cooperation with corresponding closure apertures 54 in the lower end panels.

Also according to a preferred embodiment of the invention, to facilitate forming of the blank 12 and removal of the blank 12 from a web of material from which the blank 12 is struck, the degree of curvature of the top edge of each bottom end panel 40 is minimized. This is accomplished by forming the securement tabs 46 such that the unjoined sides of securement tabs 46 abut the portions of the end panels to which they are adjacent. In this manner, the amount of scrap material produced when the web is formed is minimized in that no scrap material is formed between the securement tabs 46 and the adjacent portions of the end panels 40. The blank 12 is easier to remove from its web if there is little or no scrap material which must be removed to free the blank 12.

Features not pertinent to the operation of the invention but which help demonstrate a useful environment are also illustrated in the drawings; for example, interior article apertures 30, apertures in the lower end panels 40 and corresponding notches in the upper end panels 50 for refrigeration/ventilation, apertures in the bottom wall/base panel 20 to facilitate handling of the carrier and blank on particular machinery, and stabilizing flaps joined to the top wall/article-receiving panel 22 at the interior apertures 30.

Modifications may be made in the foregoing without departing from the scope and spirit of the claimed invention.

For example, in the drawings the securement tabs 46 are illustrated as foldably adjoined to the end walls/panels 40 at narrow portions of the locking tabs 42. However, the securement tabs 46 may also be joined to the end panels 40 along their side adjacent the stabilizing tabs 44 or along the bottom edges of the stabilizing tabs 44.

What is claimed is:

1. An article tray comprising:

spaced apart substantially parallel top and bottom walls, a plurality of apertures formed in said top wall adjacent each end edge thereof, lower end panels each joined along a bottom edge thereof to an end edge of said bottom wall and disposed in substantially perpendicular relation to said top and bottom walls, a plurality of upstanding locking tabs each having at least one shoulder said locking tabs being formed along a top edge of each of said end panels and respectively disposed in said apertures with said at least one shoulder of each said locking tab in abutting contact with a top surface of said top wall, a plurality of upstanding stabilizing tabs formed along the top edge of each of said lower end panels, interspersed between said locking tabs and arranged to engage the bottom surface of said top wall, and a plurality of securement tabs foldably joined to said lower end panels interspersed between said locking tabs and said stabilizing tabs wherein an unjoined top edge of said securement tab is pivoted into abutting relationship with a bottom surface of said top wall such that portions of said top wall are constrained between pairs of said at least one shoulder and said securement tabs.

2. A tray according to claim 1, wherein said securement tabs adjoin said lower end panels adjacent respective said shoulders.

3. A blank for forming an article tray comprising:

a base panel and an article-receiving panel foldably adjoined along side edges by a first side wall panel, said article-receiving panel having a plurality of apertures adjacent each end edge thereof, means for maintaining said base panel and said article-receiving panels in spaced-apart parallel relationship with respect to one another when the article tray is erected, lower end panels each foldably joined along a first edge thereof to an end edge of said base panel, a plurality of locking tabs depending from a second edge of said lower end panels each said locking tab having at least one shoulder wherein when said lower end panels are pivoted into an upright condition with respect to the erected article tray, said shoulders of said locking tabs may be inserted through said apertures into abutting contact with a first surface of said article-receiving panel, a plurality of stabilizing tabs depending from said second edge of said lower end panels interspersed between said locking tabs wherein when said shoulders of said locking tabs are placed into abutting contact with said first surface of said article-receiving panel said stabilizing tabs engage an opposing second surface of said article-receiving panel, and a plurality of securement tabs foldably joined to lower end panels interspersed between said locking tabs and said stabilizing tabs wherein when said shoulders of said locking tabs are placed into abutting contact with said first surface of said article-receiving panel said securement tabs may be pivoted into engagement with said second surface of said article-receiving panel such that portions of said article-receiving panel are wedged between adjacent ones of said shoulders and said stabilizing tabs.

4. A blank according to claim 3, wherein said securement tabs adjoin said lower end panels adjacent respective said shoulders.

5. The blank of claim 3, wherein unjoined edges of said securement tabs abut adjacent portions of said end panels.

6. An article tray comprising:

spaced apart substantially parallel top and bottom walls, a plurality of apertures formed in said top wall adjacent each end edge thereof, lower end panels each joined along a bottom edge thereof to an end edge of said bottom wall and disposed in substantially perpendicular relation to said top and bottom walls, a plurality of upstanding locking tabs each having at least one shoulder and being formed along a top edge of each of said end panels and respectively disposed in said apertures with said at least one shoulder of each said locking tab in abutting contact with a top surface of said top wall, and a plurality of securement tabs foldably joined to said lower end panels interspersed between said locking tabs wherein an unjoined top edge of said securement tab is pivoted into abutting relationship with a bottom surface of said top wall such that portions of said top wall are constrained between pairs of said at least one shoulder and said securement tabs.

7. A tray according to claim 6, wherein said securement tabs adjoin said lower end panels adjacent respective said shoulders.

* * * * *